US007117652B2

(12) United States Patent
Huber et al.

(10) Patent No.: US 7,117,652 B2
(45) Date of Patent: Oct. 10, 2006

(54) THATCH EAVE MEMBER

(76) Inventors: Barry Ray Huber, Rt. 10, Box 596, Lake City, FL (US) 32025; Abram Huber, Rt. 10, Box 596, Lake City, FL (US) 32025

( * ) Notice: Subject to any disclaimer, the term of this patent is extended or adjusted under 35 U.S.C. 154(b) by 307 days.

(21) Appl. No.: 10/601,434

(22) Filed: Jun. 23, 2003

(65) Prior Publication Data

US 2004/0031213 A1 Feb. 19, 2004

Related U.S. Application Data

(60) Provisional application No. 60/390,374, filed on Jun. 21, 2002.

(51) Int. Cl.
*E04B 1/00* (2006.01)

(52) U.S. Cl. ..... 52/750; 52/748.1

(58) Field of Classification Search ..... 52/750, 52/748.1

See application file for complete search history.

(56) References Cited

U.S. PATENT DOCUMENTS 233,269 A * 10/1880 McClelland ..... 52/750
614,478 A 11/1898 Johnston
1,492,610 A * 5/1924 Simpson ..... 52/518
4,611,451 A * 9/1986 Symbold ..... 52/555
4,739,603 A * 4/1988 Butler ..... 52/750
5,333,431 A 8/1994 Houpt
6,226,949 B1 * 5/2001 Huber ..... 52/555

FOREIGN PATENT DOCUMENTS

| | | |
|---|---|---|
| EP | 0 202 518 | 11/1986 |
| EP | 0 340 321 | 11/1989 |
| GB | 2279974 | 1/1995 |
| WO | WO 97/14858 | 4/1997 |

* cited by examiner

*Primary Examiner*—Carl D. Friedman
*Assistant Examiner*—Tiara Robertson
(74) *Attorney, Agent, or Firm*—Thomas C. Saitta

(57) ABSTRACT

A thatch eave member formed of a plurality of individual thatch elements, either natural or synthetic, having a backing member retaining a plurality of individual thatch elements such that the free ends present a generally planar exposed face, wherein the backing member is adapted for attachment along the eave of a roof such that the exposed face matches the ends of a lowermost thatched roofing shingle or roll to give the illusion of a thicker roof, and the system comprising the combination of such eave members and roof members.

11 Claims, 2 Drawing Sheets

11
12
13
14
11
12
13
14
11
12
13
17

THATCH EAVE MEMBER

This application claims the benefit of U.S. Provisional Patent Application Ser. No. 60/390,374, filed on Jun. 21, 2002.

BACKGROUND OF THE INVENTION

This invention relates generally to the field of roofing members used to create a durable, sturdy, water impermeable roof on a home, building or other structure. More particularly, the invention relates to such roofing members known as thatching, which are used to create what are termed thatch roofs, wherein the term thatch is taken to include both natural and synthetic materials. Even more particularly, the invention relates to discrete thatch members in the forms of shingles or rolls that are applied in multiples to the roof to provide the appearance of a natural thatch roof.

Thatch roofing has been used to create shelter from the elements of sun and rain for thousands of years. The type of thatch roofing often varies by region, with roofing in the Caribbean and South Pacific typically formed of grasses or palm fronds and presenting a generally loose or random appearance, while thatch roofing in Europe is typically formed of straw and reeds and presenting a more controlled or dressed look. Thatch may be made from natural elements such as straw, grasses, reeds, palm leaves or the like, and in modern times is also made from artificial or synthetic elements, typically composed of plastic, which are formed to present the appearance of natural thatch material. The modern thatch roofing members which incorporate artificial material are more durable, typically easier to construct and apply, and are more resistant to mold, mildew and other forms of degradation or weathering. The overall appearance of the roof is more easily controlled.

Because the aesthetics of a thatched roof are unique, thatch roofing is gaining in popularity. Natural thatch is typically highly combustible, and therefore cannot pass building codes in many jurisdictions. Natural thatch is also very susceptible to rotting and degradation due to high humidity and moisture, and presents natural nesting material for insects, vermin and birds. Furthermore, natural thatching requires skilled artisans for the construction of the individual thatch members and for the installation of the roof—a skill which is rapidly disappearing. The development of synthetic or artificial thatching has lessened or obviated some of the these problems. The artificial thatching is typically produced in the form of rolls or shingles which are properly disposed on the roof to form a waterproof surface with a pleasing exterior. An example of artificial thatch elements is shown in my U.S. Pat. No. 6,226,949, the disclosure of which is incorporated herein by reference.

Since natural thatching consists of individual reeds, palm fronds, etc., multiple layers of such materials are necessary to form a water impermeable covering. Because of this necessity, the exposed ends or faces of the thatch elements along the eaves of the roof are relatively thick. In modern construction where artificial thatch elements are utilized, an underlayment of water impermeable sheet material allows the covering members to be produced as thin elements, thereby lowering manufacturing costs and easing application to form the roof. However, the use of thin shingles or rolls of synthetic thatch presents an undesirable appearance along the eaves of the building, since the entire thickness of the lowermost thatch shingle or roll is exposed to the observer. Since natural thatch roofs are by requirement relatively thick, this exposed thin edge indicates that the roof is not a true thatched roof, detracting from its appeal.

It is an object of this invention to provide an improved thatch roofing system and thatch roofing members, wherein relatively thin thatch shingles or rolls can be utilized to cover the major expanse of the roof, but wherein artificial eave members are provided which provide the illusion of a relatively thick thatch roof. It is an object to provide such artificial eave members for placement along the linear portions of the eave and at the corners, wherein the artificial eave members comprise a backing member for attachment to the edge of the eave below the upper roof surface, wherein a large number of reed members extend from the backing member and are sized such that their free ends present a generally planar, generally vertically disposed surface which is positioned even with the free ends of the lowermost shingle or roll member, giving the illusion that the lowermost thatch shingles or rolls, and therefore the entire roof, are much thicker than they actually are.

SUMMARY OF THE INVENTION

The invention is in general a thatch eave member, utilized in conjunction with known thatch roof members formed as shingles or rolls of relatively thin thickness dimension, used in multiples or in roll form to create a thatch roof on a structure which has the appearance of being a relatively thick thatch, where the thatch eave member is formed from a large number of individual thatch elements which are affixed to a backer member, such that all the thatch elements are generally aligned in parallel fashion and extend in brush-like manner from the backing member. The invention also comprises a roofing system containing the eave members and roof thatch members in combination. The thatch elements may comprise natural materials, such as for example straw, grasses, reeds, palm fronds, but more preferably comprise synthetic or artificial materials such as plastic, where the artificial thatch elements are provided with the visual appearance of natural thatch elements. The free ends of the thatch elements are exposed and trimmed as required to create a generally planar surface or angled surface as required to match the general plane containing the free ends of the thatch elements on the lowermost row of roofing shingles or rolls, when the eave member is mounted along or below the eave of the roof.

DETAILED DESCRIPTION OF THE INVENTION

Figure 1:
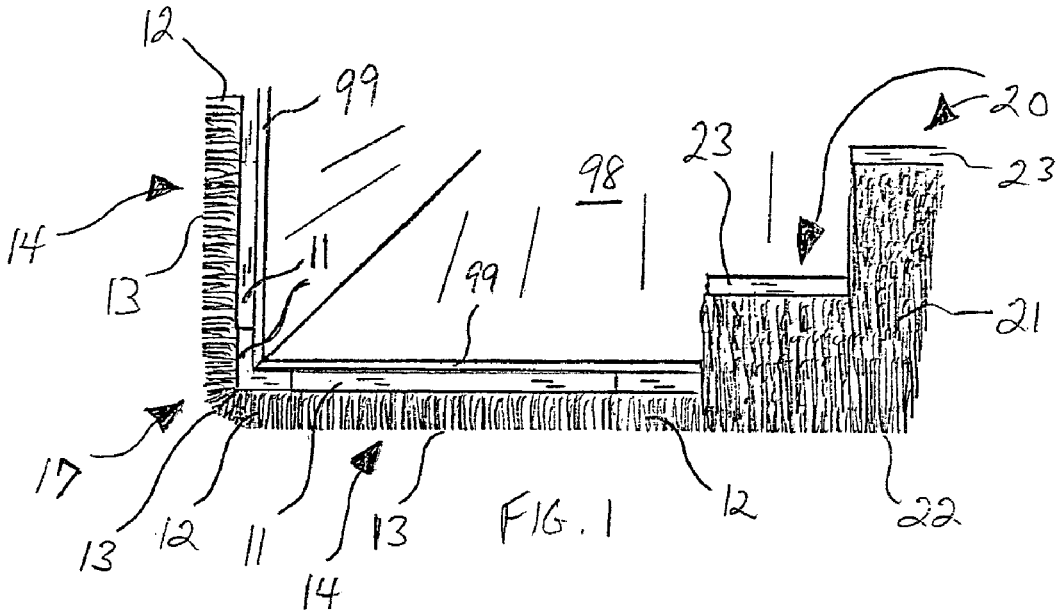
FIG. 1 is a top view of the eave members, showing both linear and curved corner members, with several thatch roofing elements in place over the eave members.

With reference to the drawings, the invention will now be described in detail with regard for the best mode and the preferred embodiments. In general, the invention comprises a thatch eave member, as well as a system comprising one or more such members in combination with thatch roofing members formed as shingles or rolls, wherein the eave member may be relatively linear for positioning along the linear portion of an eave or curved, bent or angled to define a corner member.

The eave member 14 comprises a relatively thick backer member 11, composed of suitable material such as a polymer, wood, metal, fabric or the like, which is adapted to retain the individual reeds or thatch elements 12 such that a dense expanse of free ends 13 project from the exterior side of the backing member 11 in a brush-like manner, similar in configuration to a push broom, for example. The density of the thatch elements 12 should be such that the backer member 11 is not visible through the thatch elements 12. The thatch elements 12 may be connected to the backing member 11 by any suitable means, including the use of binders or adhesives, stitching, mechanical fastening, welding, melting, integral manufacturing processes or the like. For example, a plastic or wooden backing member 11 may be provided with a large number of apertures, into which individual thatch elements 12 or bundles of thatch elements 12 are inserted and secured by mechanical fasteners, such as staples, glue or like means. The thatch elements 12 extend a short distance, approximately one to several inches for example, from the backing member 11 in generally aligned or parallel manner, such that the free ends 13 may be trimmed or manufactured to present a generally two-dimensional face or surface, preferably relatively planar, but curved, angled or textured faces may also be provided. The backing member 11 is of sufficient thickness such that the thatch elements 12 are held in a relatively rigid manner, and further such that the backing member 11 may be securely attached to the eave 99 or roof 98, typically to the depending edge board of the eave 99, in suitable fashion with the thatch elements 12 facing outward, either by direct connection to the backing member 11 or by providing additional connection mechanisms such as brackets or the like. The length of the thatch elements 12 may be relatively short in comparison to the length of the thatch elements 21 on the roof members 20 that are attached to the roof 98, since the eave members 14 are used less for function than for aesthetic purposes.

Figure 2:
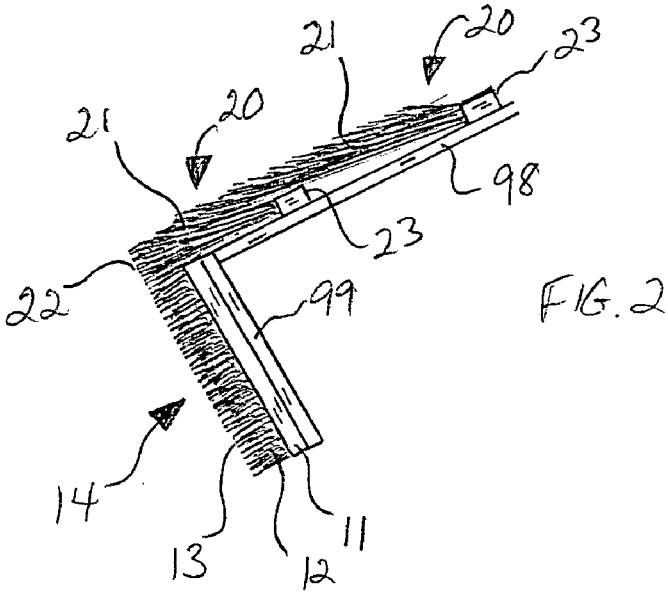
FIG. 2 is a side view showing the eave members mounted on the depending surface below the eave, showing the free ends aligned with the free ends of the roofing shingles.
Figure 3:
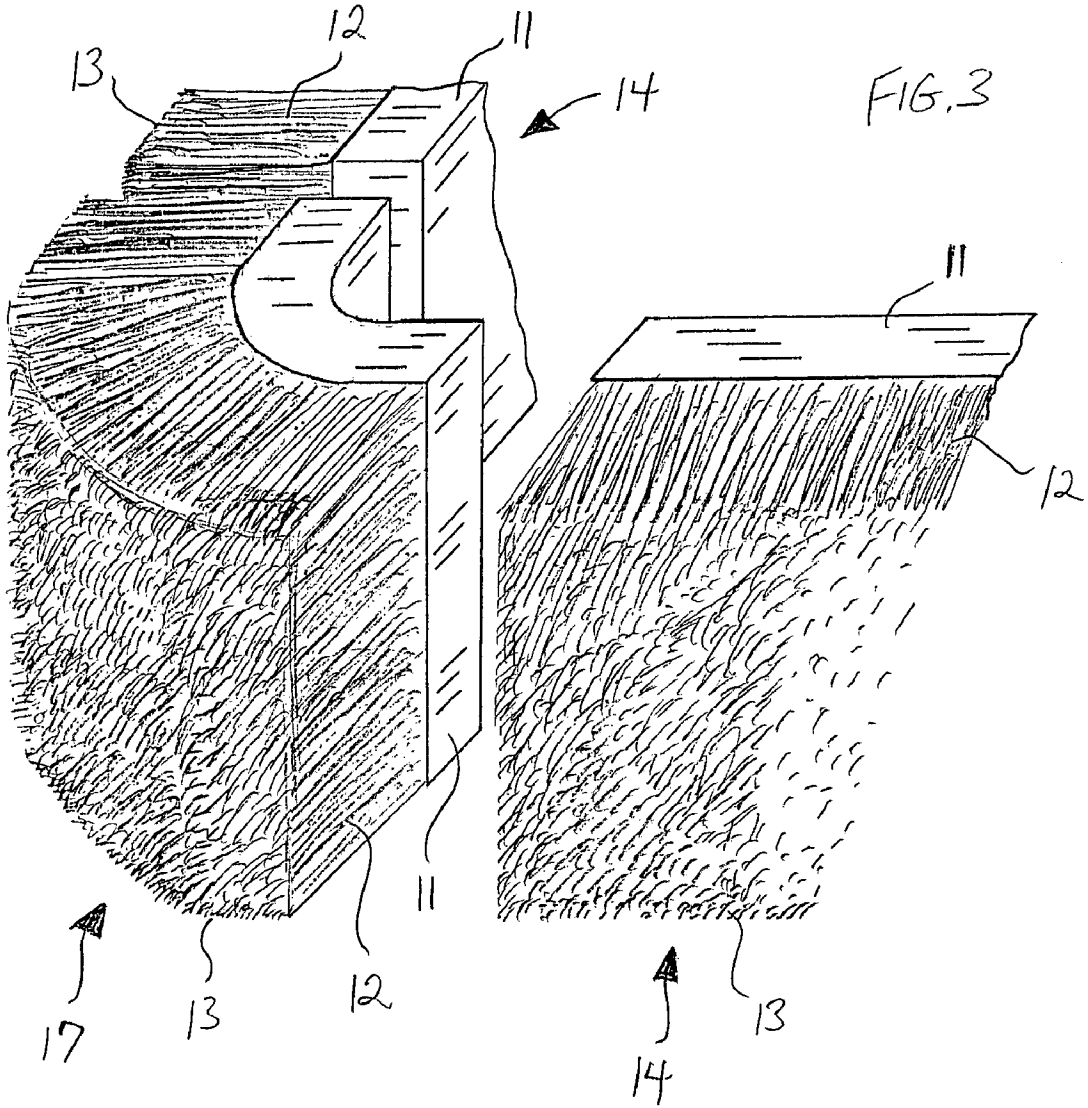
FIG. 3 is an exploded perspective view showing the eave members in more detail.

The thatch roof members 20 may be formed in any known manner, but typically comprise thatch elements 21 bound or connected to a binder, bracket or similar mounting member 23 adapted to be attached to the roof 98 using mechanical fasteners or similar means. To construct the thatch roof, the eave members 14 are attached along the eaves 99 or to the roof 98 by attaching the backer member 11 in a generally vertical manner such that a continuous expanse of thatch ends 13 face outwardly with the thatch elements 12 oriented in a relatively horizontal or downwardly sloping manner. The lowermost row of thatch roofing members 20 is then applied, either in roll form or as discrete shingles, by attaching the mounting members 23 to the roof 98 such that the lowermost rows of free ends 22 of the roof thatch elements 21 match up to the ends 13 of the eave members 14, as seen in FIGS. 1 and 2. In this manner, viewing the thatch roof from ground level presents the illusion that the entire roof is of a thickness equal to the combination of the eave members 11 and the thatch roofing members 20.

While the linear eave members 14 may merely be abutted at the corners of the eave 99, it is much preferred to provide a corner eave member 17. The corner eave member 17 to be utilized at a corner of the roof 98 is provided with a curved, bent or angled backing member 11, such that the free ends 13 extend over a 90 degree radius or angle, or over whatever radius or angle is necessary, in a curved or angled manner to meet the free ends 13 of the two adjacent linear eave members 11 in a seamless manner. As with the linear eave members 14, the lowermost thatch roofing member 20 is mounted on the corner of the roof 98 such that the free ends 22 of its thatch elements 21 blend with the free ends 13 of the thatch elements 12 of the corner eave member 17.

It is understood that certain equivalents and substitutions for elements set forth above may be obvious to those skilled in the art, and therefore the true scope and definition of the invention is to be as set forth in the following claims.

We claim:

1. A thatch roofing system comprising:

thatch roofing members each comprising thatch elements connected to a mounting member in a manner whereby said roofing member thatch elements present exposed roofing member free ends having a lowermost row;

eave members each comprising thatch elements connected to a rigid linear backer member in a manner whereby said eave member thatch elements have eave member free ends defining an exposed surface;

corner eave members each comprising thatch elements connected to a rigid non-linear backer member in a manner whereby said corner eave thatch elements have corner eave member free ends defining a non-planar exposed surface;

whereby said eave members and said corner eave members are adapted to be attached beneath said thatch roofing members such that said exposed surfaces of said eave member free ends and said corner member free ends align with said lowermost rows, and wherein said exposed surfaces of said corner member free ends align with said exposed surfaces of some of said eave members, such that the combination of said eave members, said corner eave members and said thatch roofing members makes said thatch roofing members appear to be thicker than in actuality.

2. The system of claim 1, wherein said thatch elements are composed of a synthetic material.

3. The system of claim 1, wherein said exposed surfaces of said eave members are generally planar.

4. The system of claim 1, wherein said backer members of said eave members are linear and said backer members of said corner eave members are non-linear.

5. The system of claim 4, wherein said backer members of said corner eave members are curved.

6. The system of claim 4, wherein said backer members of said corner eave members are angled.

7. The system of claim 4, wherein said exposed surfaces of said corner eave members each extend over a 90 degree radius.

8. The system of claim 4, wherein said exposed surfaces of said corner eave members each extend over a 90 degree angle.

9. A method of forming a thatch roof on a roof with eaves and corners comprising the steps of:

providing thatch roofing members, corner eave members and eave members, said thatch roofing members each comprising thatch elements connected to a mounting member in a manner whereby said roofing member thatch elements present exposed roofing member free ends having a lowermost row, said corner eve members each comprising thatch elements connected to a rigid non-linear backer member and said eave members each comprising thatch elements connected to a rigid linear backer member in a manner whereby said eave member thatch elements present exposed eave member free ends to define a surface and said corner eave member thatch elements present exposed corner eave member free ends to define a non-planar surface;

attaching said eave members to said eaves such that said surfaces defined by said eave member free ends extend along said eaves and attaching said corner eave members to said corners such that said surfaces defined by said corner eave member free ends extend across said corners;

attaching said thatch roofing members to said roof above said corner eave members and said eave members such that said lowermost rows of said roofing member free ends align with said surface defined by said eave member free ends and with said surface defined by said corner eave member free ends, such that said exposed corner eave member free ends and said eave member free ends combine with said roofing member free ends to create the illusion of said thatch roofing members having a thickness equal to the combination of said thatch roofing members and said eave members and said corner eave members.

10. The method of claim 9, wherein said eave members are attached to said eaves such that said eave member backer members are oriented generally vertically and said eave member thatch elements extend outwardly from said eaves in a downwardly sloping manner.

11. The method of claim 9, further comprising the step of forming said thatch elements of synthetic materials.

* * * * *